United States Patent [19]

Tsai

[11] Patent Number: 4,934,239

[45] Date of Patent: Jun. 19, 1990

[54] ONE MEMORY MULTI-TONE GENERATOR

[75] Inventor: M. K. Tsai, Hsin Chu City, Taiwan

[73] Assignee: United Microelectronics Corporation, Hsin Chu City, Taiwan

[21] Appl. No.: 395,288

[22] Filed: Aug. 16, 1989

Related U.S. Application Data

[63] Continuation of Ser. No. 116,968, Nov. 5, 1987, abandoned.

[51] Int. Cl.[5] ..... G10H 1/057; G10H 7/00

[52] U.S. Cl. ..... 84/627; 84/630; 84/675; 84/DIG. 11; 84/DIG. 26

[58] Field of Search ..... 84/626–633, 84/648, 662–665, 675–677, 701–711, DIG. 11, DIG. 26

[56] References Cited

U.S. PATENT DOCUMENTS 4,273,019 6/1981 Goto ..... 84/DIG. 4 X 4,472,993 9/1984 Futamese et al. ..... 84/DIG. 4 X

*Primary Examiner*—Stanley J. Witkowski

*Attorney, Agent, or Firm*—Cushman, Darby & Cushman

[57] ABSTRACT

An electronic tone generator includes a signal-generating oscillator, a memory circuit for storing tone and time data for each note to be produced and two note producing circuits, each including a first programmable counter electrically connected to the memory circuit and the signal-generating oscillator and for variably dividing signals outputted by the signal-generating oscillator in order to sequentially produce notes of predetermined frequencies and durations according to the data read from the memory circuit. The note outputs of the two note producing circuits are interrelated to produce a music effect.

11 Claims, 5 Drawing Sheets

| BEAT | MAIN ACCOMPANYING | NOTE |
|---|---|---|
| 0 | MAIN | Mi |
| 1 | ACCOMPANYING | Do' |
| $\frac{1}{2}$ | ACCOMPANYING | Mi' |
| $\frac{1}{2}$ | MAIN | Sol |
| $\frac{1}{2}$ | MAIN | Do |
| $\frac{1}{2}$ | ACCOMPANYING | Sol' |

ONE MEMORY MULTI-TONE GENERATOR

This is a continuation of application Ser. No. 116,968, filed Nov. 5, 1987, which was abandoned upon the filing hereof.

BACKGROUND OF THE INVENTION

The present invention relates to a tone generator, and more particularly to an electronic tone generator.

As shown in FIG. 1, a known electronic monotone generator includes a memory 101 for storing tone (frequency) and time data of each generated note, an address counter 102 for applying an address signal to memory 101 so that the tone information stored at a plurality of addresses in memory 101 can be read out successively, a high-frequency oscillator 103 outputting clock pulses to be divided down by a programmable counter 104 according to the data related to the musical note stored in memory 101, a wave-shaping circuit 105 which converts the selected frequency signal outputted by programmable counter 104, gives it a selected wave form and applies a desired modulating envelope to the signal, an amplifier 106 amplifying the shaped signal wave form, an electroacoustic transducer 107 converting the output of amplifier 106 to an acoustic music sound and another programmable counter 108 dividing clock pulses supplied from another oscillator 109. The division ratio of programmable counter 108 is variable in response to the time data stored in memory 101. Since the music produced by such an electronic tone generator is inferior to that produced by a mechanical music box and the sound quality produced thereby is of monotone quality, a Japanese patentee, Kabushiki Kaisha Suwa Seikosha, has sought patenting an electronic tone generator bearing U.S. Pat. No. 4,273,019 which makes an improvement over the above described electronic monotone generator in that not only it is capable of producing music that compares in tonal quality with a good mechanical tone generator, but also the good tonal quality can be combined with the advantages of electronic circuitry in allowing reprogramming of the melody and the elimination of cumbersome mechanical parts, such as a winding spring.

As shown in FIG. 2A, the patented electronic tone generator includes at least two musical note producing circuits 201, 202 which are the same as the note producing circuit 110 of FIG. 1, a mixing amplifier 203 combining and amplifying the signal wave forms produced by circuits 201, 202, an electroacoustic transducer 204 converting the amplified signal into a musical sound and two oscillator 208, 209 for note and timing signals respectively serving note producing circuits 201, 202 to further simplify the construction. As one of the disclosed examples in the patent, first musical note producing circuit 201 produces notes of a desired melody and if we designate the audio frequency of the music note produced by circuit 201 as f, then second note producing circuit 202 can be adapted to produce a note having an audio frequency of $f \pm \Delta f$ so that a beat frequency is introduced into the music sound. The more detailed block diagram of FIG. 2A is shown in FIG. 2B which corresponds to FIG. 9 in the above mentioned patent. Further information relating to FIG. 2B, if desired, can be obtained from the patent the contents of which are incorporated herein for reference purpose.

Although the patented electronic tone generator has achieved the objects that it produces more acoustically pleasing music and music with special sound effect, one note may be produced concurrently with the sounding of another note, successive notes in the same melody can overlap in sound, output signals can include a beat frequency or an echo effect and it can simultaneously play two independent melodies, one melody having special sound effects, it still has the following disadvantages:

(1) Each note producing circuit 201 (202) has its own memory 402 (402'). One of memories 402, 402' stores tone and time data for the notes of a main melody while the other one stores data for the notes of an accompanying melody. It is quite possible, however, that the number of notes for a main melody (accompanying melody) is larger than that for an accompanying melody (main melody) and therefore it often results in that both memories 402, 402' cannot be fully utilized and are wasted to some extent.

(2) Each producing circuit 201 (202) has its own circuit means 403', 406 (403, 406'). It is tried by the present inventor to use a common circuit for two or more note producing circuits.

The inventor attempts to overcome the shortcomings encountered by the patented electronic tone generator while maintaining all the advantages it represents.

SUMMARY OF THE INVENTION

It is therefore an object of the present invention to provide an electronic tone generator using only one memory for two or more note producing circuits so that the memory is utilized to the largest extent.

It is a further object of the present invention to provide an electronic tone generator using only one circuit means including a programmable counter and an address counter so that the present tone generator is cost effective and more efficient.

According to the present invention, an electronic tone generator includes a signal-generating oscillator, a memory circuit for storing tone and time data for each note to be produced and two note producing circuits, each including a first programmable counter electrically connected to the memory circuit and the signal-generating oscillator, for variably dividing signals outputted by the signal-generating oscillator in order to sequentially produce notes of predetermined frequencies and durations according to the data read from the memory circuit, the note output of the two note producing circuits being interrelated to produce a music effect.

As a first example, the outputs can be interrelated so that the two note producing circuits respectively produce a main melody and an accompanying melody.

As a second example, the note producing circuits can produce the same notes and the output notes are interrelated to have a time difference therebetween so that an echo effect is produced.

As a third example, the note producing circuits can produce substantially the same notes with the output notes being interrelated to have a small audio frequency difference therebetween so that a beat frequency is introduced into the music effect.

Preferably, the electronic tone generator further includes a selecting and latching circuit electrically connected to the first programmable counters and the memory circuit and for selecting to which first programmable counter a note data in the memory circuit should be sent and latching the sent tone data for the selected first programmable counter until a next tone data sent to the selected first programmable counter replaces the sent tone data.

Preferably, the electronic tone generator further includes a circuit means electrically connected to the oscillator and the memory circuit, for governing the duration of each produced note by the two note producing circuits in response to the time data in the memory circuit.

The circuit means can include a second programmable counter variably dividing signals outputted from the oscillator according to the time data in the memory and an address counter receiving the output of the second programmable counter and outputting a signal to the memory circuit to advance the memory address so that the second and one of the first programmable counters obtain data for the next note.

Preferably, the electronic tone generator further includes means for mixing and amplifying note wave forms produced by the note producing circuits and an electroacoustic transducer receiving the output of the mixing and amplifying means and outputting a sound of a special sound effect.

Preferably the electronic tone generator further includes an enveloping circuit electrically connected between the mixing and amplifying means and one of the first programmable counters and for applying a selected modulating envelope to the outputted signal of the one of the first programmable counters.

Certainly, each note producing circuit can further include a wave shaping circuit receiving the output signal of the first programmable counter to give it a desired waveform.

The present invention may best be understood through the following descriptions with reference to the accompanying drawings, in which:

DETAILED DESCRIPTION OF THE PREFERRED EMBODIMENT

Figure 1:
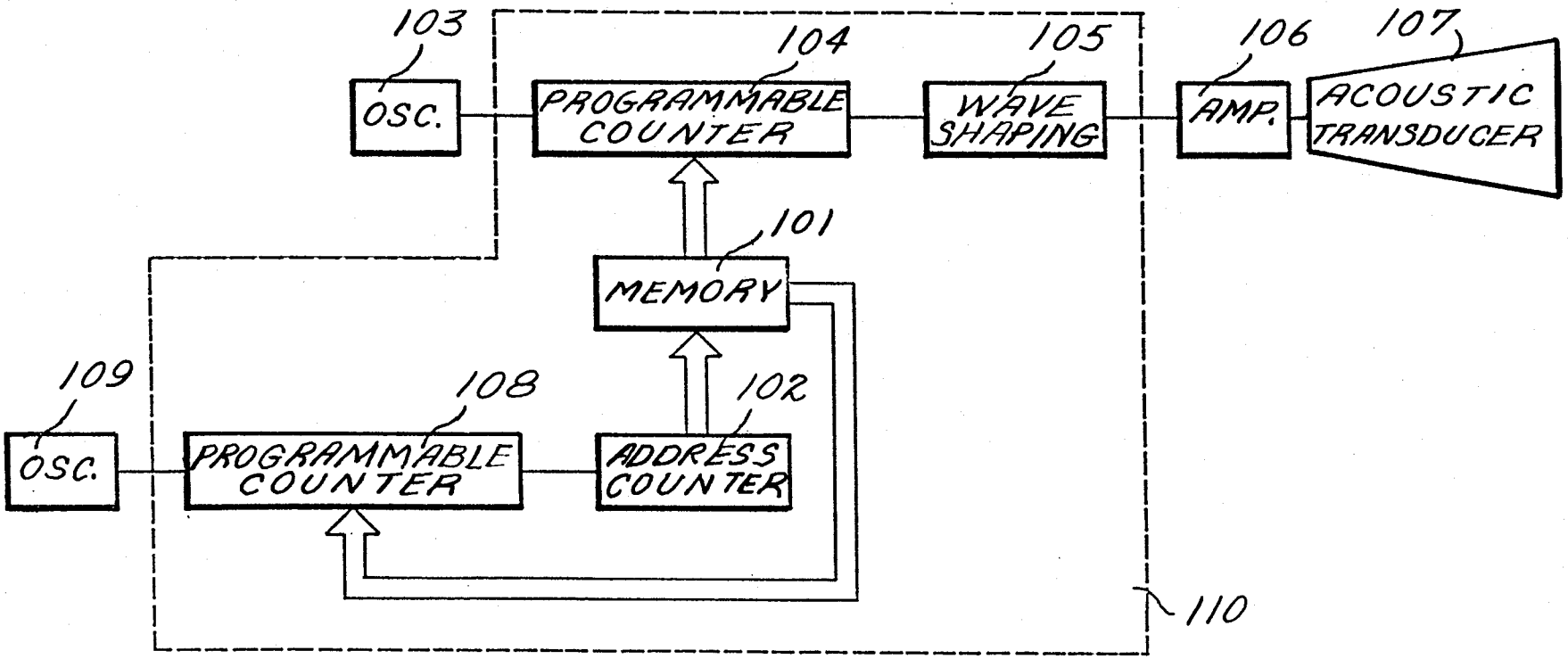
Fig. 1. (PRIOR ART)
FIG. 1 is a block diagram showing a known electronic monotone generator.
Figure 2A:
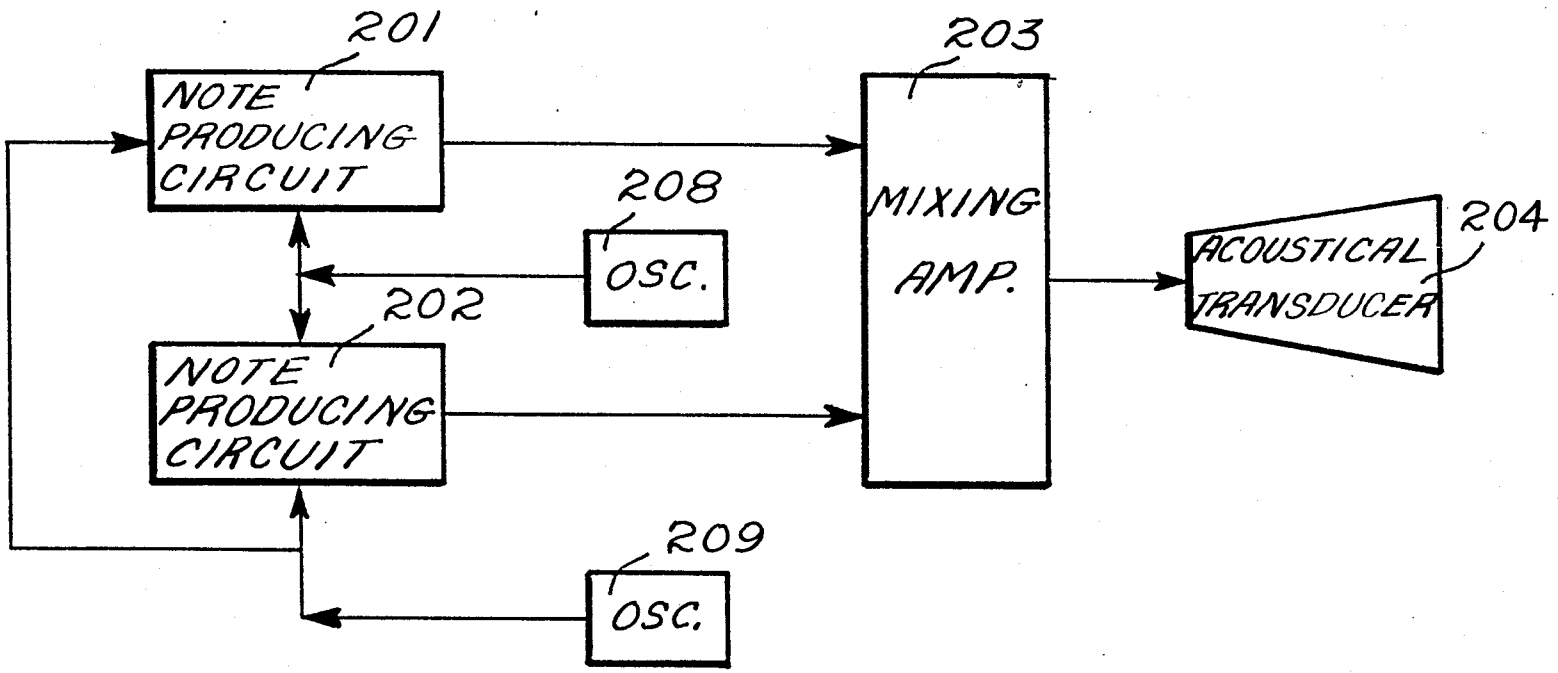
Fig. 2A. (PRIOR ART)
FIG. 2A is a simplified block diagram showing a most advanced prior electronic tone generator.
Figure 2B:
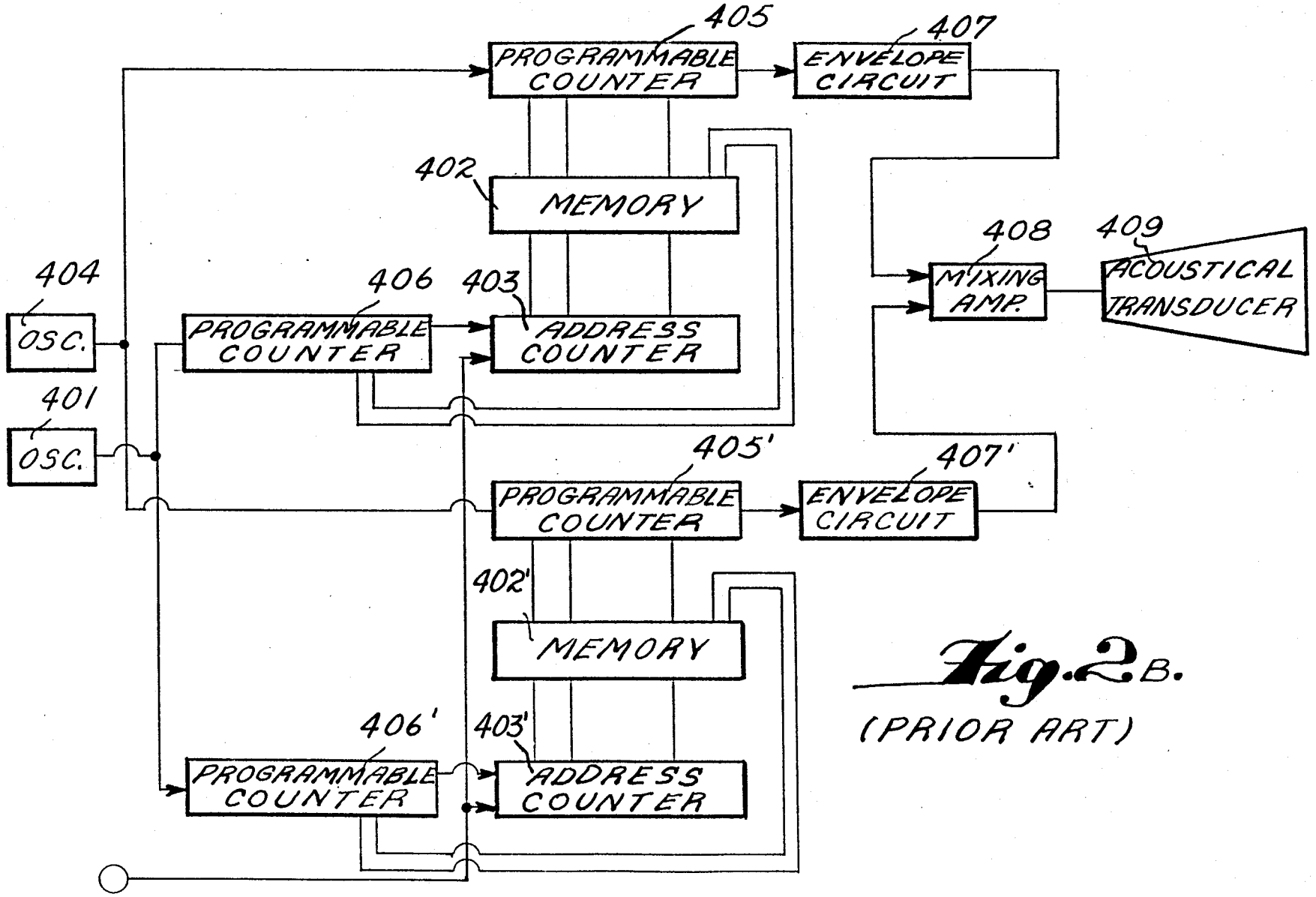
Fig. 2B. (PRIOR ART)
FIG. 2B is a more detailed block diagram showing an electronic tone generator in FIG. 2A.
Figure 3:
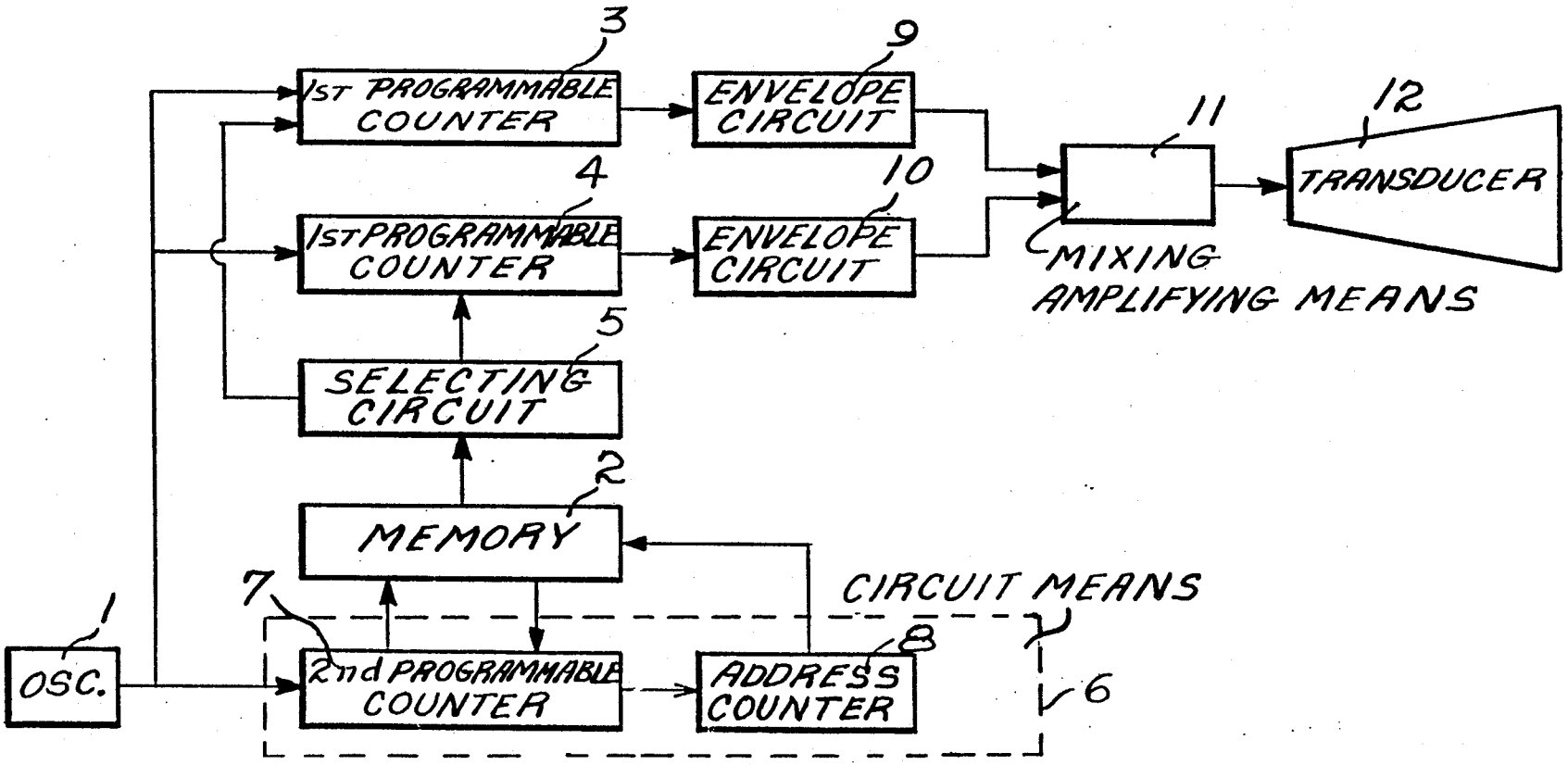
FIG. 3 is a block diagram showing a preferred embodiment of an electronic tone generator according to the present invention.

Referring now to FIG. 3, an electronic tone generator according to the present invention includes a signal-generating oscillator 1, a memory circuit 2, two note producing circuits each including a first programmable counter 3, 4, a selecting circuit 5, a circuit means 6 including a second programmable counter 7 and an address counter 8, two enveloping circuits 9, 10, means for mixing and amplifying 11 and an electroacoustic transducer 12. Memory 2 stores tone and time data for each note to be produced by first programmable counters 3, 4 each of which is electrically connected to memory 2 and oscillator 1 for variably dividing signals outputted by oscillator 1 in order to sequentially produce notes of predetermined frequencies and durations according to the note and time data read from memory 2.

Selecting and latching circuit 5 is electrically connected to first programmable counters 3, 4 and memory 2 for selecting to which first programmable counter a note data in memory 2 should be sent and latching the sent tone data for the selected first programmable counter until a next tone data sent to the selected first programmable counter replaces the sent tone data.

Circuit means 6 is electrically connected to oscillator 1 and memory 2 and operates in response to the time data in memory 2, and is used for governing the duration of each produced note.

Circuit means 6 can include a second programmable counter 7 variably dividing signals outputted from oscillator 1 according to the time data stored in memory 2 and an address counter 8 receiving the output of second programmable counter 7 and outputting a signal to memory 2 to advance the memory address in order to sequentially fetch the next note so that the second and one of first programmable counters 7, 3 (4) obtain tone and time data for the next note.

Each enveloping circuit 9 (10) is electrically connected between mixing and amplifying means 11 and one of first programmable counters 3, 4 for applying a selected modulating envelope to the outputted signal from the relevant first programmable counter 3 (4).

Certainly, each note producing circuit can further include a wave shaping circuit receiving the output signal of the first programmable counter to give it a desired waveform.

Means 11 mixes and amplifies note wave forms produced by the two note producing circuits. Electroacoustic transducer 12 receives the output of mixing and amplifying means 11 and outputs audible sound.

Generally, the note outputs of the two note producing circuits are interrelated to produce a music effect. For example, the two note producing circuits can respectively produce a main melody and an accompanying melody. Alternatively, the two note producing circuits can produce the same notes and the output notes are interrelated to have a time difference therebetween so that an echo effect is produced. As a further example, the two note producing circuits can produce substantially the same notes with the note outputs being interrelated to have a small audio frequency difference therebetween so that a beat frequency is introduced into the music effect.

Figures 4A, 4B:
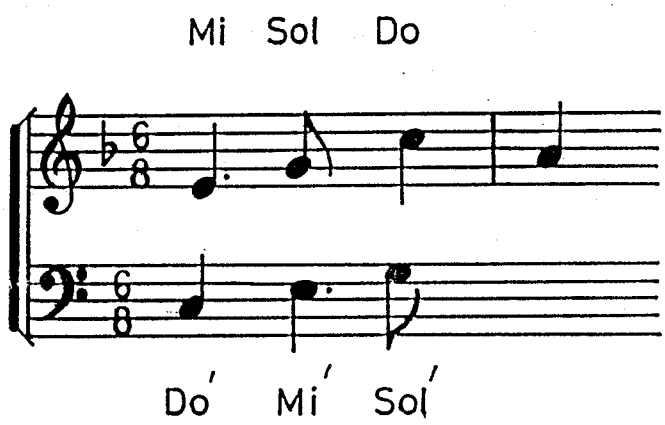
FIG. 4A is a music score showing a measure of a main melody and a measure of an accompanying melody.
FIG. 4B is a table showing how the notes in the measures in FIG. 4A are stored in the memory of an electronic tone generator according to the present invention.

Referring now to FIG. 4A, there is shown a music score for a measure of a main melody and a measure of an accompanying melody. FIG. 4B is a table showing how the notes in the measure in FIG. 4A are stored in the memory 2 of an electronic tone generator according to the present invention.

The left column in FIG. 4B denotes the beat number from which the next note is to be produced. The middle column represents tone generating circuit bits indicating to which melody (main or accompanying) the note to be produced belongs. The right column lists the notes in sequence of the main and accompanying melodies to be produced.

While the present invention has been described by means of the preferred embodiments with reference to the accompanying drawings, it is to be noted that numerous equivalent modifications can be exercised without departing from the scope of the appended claims.

What is claimed is:

1. An electronic tone generator comprising:

a signal-generating oscillator;

a memory circuit for storing tone and time data and corresponding tone generating circuit bits for each note to be produced; and two note producing circuits, each including a first programmable counter having a control input connected to receive data from said memory circuit and a signal input coupled to receive an output of said signal-generating oscillator, said note producing circuits variably dividing signals produced by said signal-generating oscillator in order to sequentially produce note outputs of predetermined frequencies and durations according to data read from said memory circuit, said note producing circuits being selected in response to said corresponding tone generating circuit bits, the note outputs of said two note producing circuits being used to produce a music effect.

2. An electronic tone generator as claimed in claim 1, wherein said note outputs are interrelated so that said two note producing circuits respectively produce a main melody and an accompanying melody.

3. An electronic tone generator as claimed in claim 1, wherein said note producing circuits produce equivalent notes having a time difference therebetween so as to produce an echo effect.

4. An electronic tone generator as claimed in claim 1, wherein said note producing circuits produce notes having a small audio frequency difference therebetween so as to introduce a beat frequency into said music effect.

5. An electronic tone generator as claimed in claim 1, further comprising:

a selecting and latching circuit, electrically connected to said first programmable counters and said memory circuit, for selecting one of said first programmable counters in response to said tone generating circuit bits, thereby latching said tone data corresponding to said tone generating circuit bits for said selected first programmable counter until a next tone data sent to said selected first programmable counter replaces said tone data corresponding to said tone generating circuit bits.

6. An electronic tone generator as claimed in claim 5, further comprising:

circuit means, electrically connected to said oscillator and said memory circuit, operating in response to said time data in said memory circuit, for governing the duration of the note outputs of said two note producing circuits.

7. An electronic tone generator as claimed in claim 6, wherein said circuit means includes:

a second programmable counter variably dividing signals outputted from said oscillator according to said time data in said memory circuit; and an address counter receiving an output of said second programmable counter and outputting a signal to said memory circuit to advance a memory address so that said second programmable counter and one of said first programmable counters obtain data for a next note.

8. An electronic tone generator as claimed in claim 7, further comprising:

means for mixing and amplifying note wave forms produced by said note producing circuits; and an electroacoustic transducer receiving an output of said mixing and amplifying means and outputting a sound of a special sound effect.

9. An electronic tone generator as claimed in claim 8, further comprising an enveloping circuit, electrically connected between said mixing and amplifying means and one of said first programmable counters, for applying a selected modulating envelope to the outputted signal of said one of said first programmable counters.

10. An electronic tone generator comprising:

a signal generating oscillator;

a memory circuit for storing tone and time data and corresponding tone generating circuit bits for each note to be produced; and at least two tone producing circuits, each including a first programmable counter having a control input connected to receive data from said memory circuit and a signal input coupled to receive an output of said oscillator, said tone producing circuits each producing a tone in response to said corresponding tone and time data and said corresponding tone generating circuit bits.

11. An electronic tone generator as claimed in claim 10, wherein said memory circuit includes:

a second programmable counter to control a time period before an occurrence of a next tone;

an address counter for sequentially fetching said next tone; and a selecting circuit to select one of said tone producing circuits to receive said corresponding tone and time data.

* * * * *